US011230102B2

(12) United States Patent
Nakai et al.

(10) Patent No.: US 11,230,102 B2
(45) Date of Patent: Jan. 25, 2022

(54) LIQUID DISCHARGE HEAD, DISCHARGE DEVICE, AND LIQUID DISCHARGE APPARATUS

(71) Applicant: Ricoh Company, Ltd., Tokyo (JP)

(72) Inventors: Takayuki Nakai, Kanagawa (JP); Shiomi Andoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/060,254

(22) Filed: Oct. 1, 2020

(65) Prior Publication Data

US 2021/0107281 A1 Apr. 15, 2021

(30) Foreign Application Priority Data

Oct. 11, 2019 (JP) ..... JP2019-187565

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
CPC ..... B41J 2/1433; B41J 2002/14419; B41J 2/14274
See application file for complete search history.

(56) References Cited

U.S. PATENT DOCUMENTS

2015/0077469 A1* 3/2015 Kohda ..... B41J 2/14209 347/40
2016/0082728 A1 3/2016 Kohda et al.
2016/0096369 A1 4/2016 Shimizu et al.
2016/0185113 A1 6/2016 Yoshida et al.
2017/0087865 A1 3/2017 Yoshida et al.
2017/0096015 A1 4/2017 Odaka et al.
2017/0120602 A1 5/2017 Nakai et al.
2017/0157924 A1 6/2017 Otome et al.
2017/0225485 A1 8/2017 Nakai
2017/0297333 A1 10/2017 Kohda et al.
2018/0194135 A1 7/2018 Iwama et al.
(Continued)

FOREIGN PATENT DOCUMENTS

JP 2015-186901 10/2015
JP 2017-100462 6/2017

*Primary Examiner* — Bradley W Thies
(74) *Attorney, Agent, or Firm* — Xsensus LLP

(57) ABSTRACT

A liquid discharge head includes a nozzle plate, a channel plate, a common channel substrate, and a wall member. The nozzle plate includes a plurality of nozzles configured to discharge liquid. The channel plate includes a plurality of pressure chambers communicated with the nozzles, respectively. The common channel substrate includes a common channel communicated with the pressure chambers. The wall member includes a deformable region in a part of a wall surface of the common channel. The channel plate and the common channel substrate are disposed with the wall member interposed between the channel plate and the common channel substrate. The channel plate includes an air chamber facing the deformable region. The channel plate includes a bridge portion partially dividing the air chamber in a nozzle arrangement direction in which the nozzles are arranged. The bridge portion is not in contact with the wall member and the nozzle plate.

20 Claims, 19 Drawing Sheets

(56) References Cited

U.S. PATENT DOCUMENTS

| | | | |
|---|---|---|---|
| 2018/0257374 | A1 | 9/2018 | Yoshida et al. |
| 2018/0272730 | A1 | 9/2018 | Odaka et al. |
| 2018/0272740 | A1 | 9/2018 | Otome et al. |
| 2018/0272743 | A1 | 9/2018 | Nakai et al. |
| 2019/0084313 | A1 | 3/2019 | Kohda et al. |
| 2019/0358953 | A1 | 11/2019 | Iwata et al. |
| 2020/0094573 | A1 | 3/2020 | Kohda et al. |
| 2020/0094595 | A1 | 3/2020 | Iwama et al. |

* cited by examiner

LIQUID DISCHARGE HEAD, DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-187565, filed on Oct. 11, 2019, in the Japan Patent Office, the entire disclosure of which is hereby incorporated by reference herein.

BACKGROUND

Technical Field

Embodiments of the present disclosure relate to a liquid discharge head, a discharge device, and a liquid discharge apparatus.

Related Art

In a liquid discharge head, in order to restrain the mutual interference, for example, a wall surface of a common channel is formed as a restorable, deformable damper region to attenuate a pressure wave propagated through the wall surface.

For example, there is known a liquid discharge head that includes a common chamber substrate, a wall member, a channel plate, and a common liquid chamber member. The wall member forms a deformable damper region in a part of a wall surface of the common chamber substrate. The channel plate and the common liquid chamber member are laminated with the wall member interposed between the channel plate and the common liquid chamber member. The channel plate includes a concave damper chamber corresponding to the damper region. A concave bottom portion of the damper chamber is provided with a support portion connected to the wall surface of the wall member facing in a direction of lamination. The support portion is a wall portion provided on the wall surface of the damper chamber in a direction orthogonal to the nozzle arrangement direction. The wall portion is provided with one or more passages through which air flows.

SUMMARY

In an aspect of the present disclosure, there is provided a liquid discharge head that includes a nozzle plate, a channel plate, a common channel substrate, and a wall member. The nozzle plate includes a plurality of nozzles configured to discharge liquid. The channel plate includes a plurality of pressure chambers communicated with the plurality of nozzles, respectively. The common channel substrate includes a common channel communicated with the plurality of pressure chambers. The wall member includes a deformable region in a part of a wall surface of the common channel. The channel plate and the common channel substrate are disposed with the wall member interposed between the channel plate and the common channel substrate. The channel plate includes an air chamber facing the deformable region. The channel plate includes a bridge portion partially dividing the air chamber in a nozzle arrangement direction in which the plurality of nozzles are arranged. The bridge portion is not in contact with the wall member and the nozzle plate.

In an aspect of the present disclosure, there is provided a liquid discharge head that includes a plurality of nozzles, a plurality of pressure chambers, a common channel, and an air chamber. The plurality of nozzles is configured to discharge liquid. The nozzles include a first wall comprised of a nozzle plate. The plurality of pressure chambers respectively are communicated with the nozzles. The pressure chambers include a second wall comprised of a channel plate. The common channel is communicated with the pressure chambers. The common channel includes a third wall comprised of a common channel substrate. The air chamber has a wall member including a deformable region in a part of a wall surface of the common channel. The channel plate and the common channel substrate are disposed with the wall member interposed between the channel plate and the common channel substrate. The channel plate includes a bridge portion partially dividing the air chamber in a nozzle arrangement direction in which the nozzles are arranged. The bridge portion is not in contact with the wall member and the nozzle plate.

In another aspect of the present disclosure, there is provided a discharge device including the liquid discharge head.

In still another aspect of the present disclosure, there is provided a liquid discharge apparatus including the discharge device.

In still yet another aspect of the present disclosure, there is provided a liquid discharge apparatus including the liquid discharge head.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
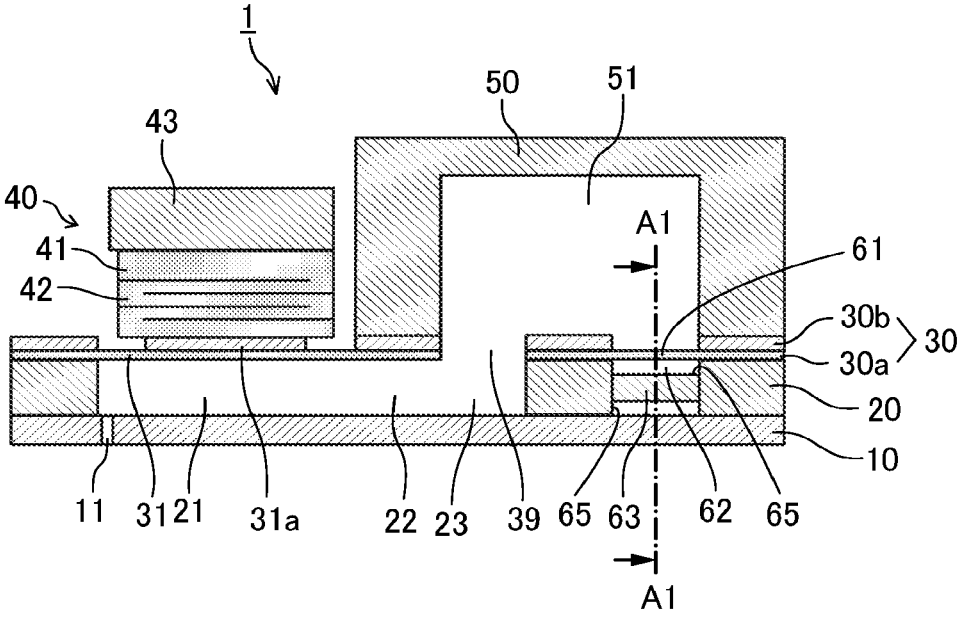
FIG. 1 is a cross-sectional view of a liquid discharge head according to a first embodiment of the present disclosure, taken along line B1-B1 in FIG. 2 in a direction perpendicular to a nozzle array direction of the liquid discharge head.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2A:
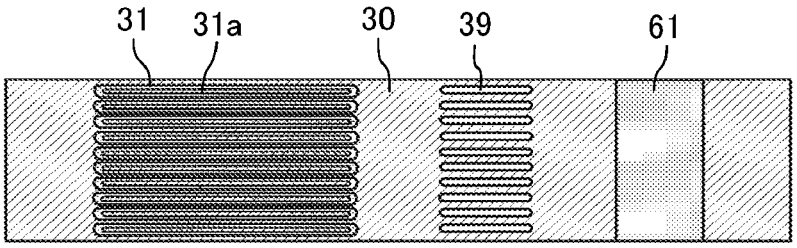
FIGS. 2A, 2B, and 2C are plan views of members of the liquid discharge head illustrated in FIG. 1.
Figure 2B:
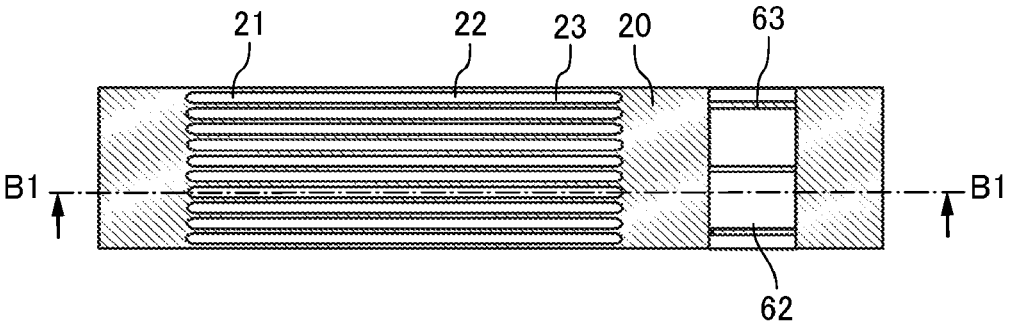
Figure 2C:
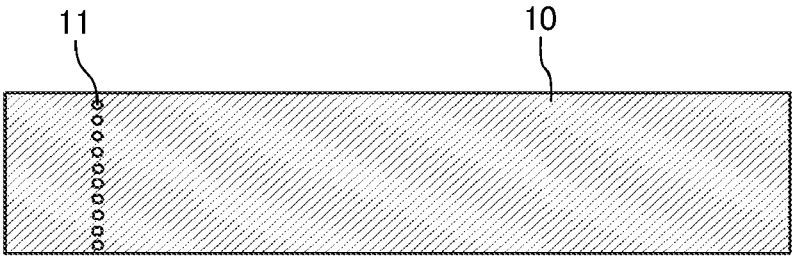
Figure 3:
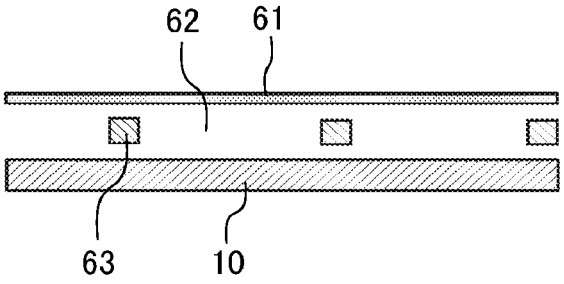
FIG. 3 is a cross-sectional view of the liquid discharge head taken along line A1-A1 in FIG. 1 in the nozzle arrangement direction.

Below, embodiments of the present disclosure are described with reference to the attached drawings. A first embodiment of the present disclosure is described with reference to FIGS. 1 to 3. FIG. 1 is a cross-sectional view of a liquid discharge head according to the first embodiment of the present disclosure, taken along line B1-B1 of FIG. 2B in a direction orthogonal to a nozzle arrangement direction of the liquid discharge head. FIGS. 2A, 2B, and 2C are plan views of members of the liquid discharge head of FIG. 1. FIG. 3 is a cross-sectional view of the liquid discharge head taken along line A1-A1 of FIG. 1 in the nozzle arrangement direction.

In the liquid discharge head 1, a nozzle plate (nozzle substrate) 10, a channel plate 20, and a diaphragm member 30 as a wall member are laminated and bonded one on another. The liquid discharge head 1 further includes a piezoelectric actuator 40 to displace a vibration region (diaphragm region, diaphragm) 31 of the diaphragm member 30 and a common channel substrate 50 that also serves as a frame substrate of the liquid discharge head.

The nozzle plate 10 has a nozzle row in which a plurality of nozzles 11 are arranged.

The channel plate 20 forms a plurality of pressure chambers 21 communicated with the plurality of nozzles 11, a plurality of individual supply channels 22 that also serve as fluid restrictors communicated with the respective pressure chambers 21, and one or more intermediate supply channels 23 that serve as one or more grooves communicated with the plurality of individual supply channels 22.

The diaphragm member 30 has a plurality of displaceable vibration regions 31 that form wall surfaces of the pressure chambers 21 of the channel plate 20. Here, the diaphragm member 30 has a two-layer structure and includes a first layer 30*a* forming a thin portion and a second layer 30*b* forming a thick portion in this order from a side facing the channel plate 20. Note that the structure of the diaphragm member is not limited to such a two-layer structure but may be any suitable layer structure.

The displaceable vibration region 31 is formed in a portion corresponding to the pressure chamber 21 in the first layer 30*a* that is a thin portion. The vibration region 31 includes an island-shaped convex portion 31*a* that is a thick portion bonded to the piezoelectric actuator 40 in the second layer 30*b*.

The piezoelectric actuator 40 including an electromechanical transducer element serving as a driving device (an actuator device or a pressure generator device) to deform the vibration region 31 of the diaphragm member 30 is disposed on a side of the diaphragm member 30 opposite a side facing the pressure chamber 21.

In the piezoelectric actuator 40, a piezoelectric member 41 bonded on a base 43 is grooved by half-cut dicing, to form a desired number of columnar piezoelectric elements 42 at predetermined intervals in a comb shape.

The plurality of piezoelectric elements 42 are used as a piezoelectric element to which a driving voltage is alternately applied and a piezoelectric element to be a support portion. The piezoelectric element 42 to which the driving voltage is applied is bonded to the island-shaped convex portion 31*a* of the vibration region 31. The piezoelectric element serving as the support portion is bonded to a thick portion between the adjacent vibration regions 31.

The piezoelectric member 41 includes piezoelectric layers and internal electrodes alternately laminated on each other. Each internal electrode is led out to an end surface and connected to an external electrode (end surface electrode). The external electrode is connected with a flexible wiring member.

The common channel substrate 50 forms a common channel 51. The common channel 51 communicates with an intermediate supply channel 23 via an opening 39 provided in the diaphragm member 30.

In the liquid discharge head 1, for example, the voltage to be applied to the piezoelectric element 42 is lowered from a reference potential (intermediate potential) so that the piezoelectric element 42 contracts to pull the vibration region 31 of the diaphragm member 30 to increase the volume of the pressure chamber 21. As a result, liquid flows into the pressure chamber 21.

Then, the voltage to be applied to the piezoelectric element 42 is increased to expand the piezoelectric element 42 in a direction of lamination. The vibration region 31 of the diaphragm member 30 is deformed in a direction toward the nozzle 11 to reduce the volume of the pressure chamber 21. As a result, the liquid in the pressure chamber 21 is pressurized and discharged from the nozzle 11.

The method of driving the head is not limited to the above-described example (pull-push discharge), and pull discharge or push discharge may be performed in accordance with the way of applying the drive waveform.

Next, a portion related to a damper function (vibration damping function) in the first embodiment is described.

In the present embodiment, the diaphragm member 30 is provided as a wall member that forms a deformable region (hereinafter, referred to as a "damper region") 61 in a part of the wall surface of the common channel 51. The channel plate 20 and the common channel substrate 50 are arranged with the diaphragm member 30, which is a wall member, interposed between the channel plate 20 and the common channel substrate 50.

The diaphragm member 30 includes the damper region 61 in the first layer 30*a*.

The channel plate 20 is provided with an air chamber 62 as a gas chamber to which the damper region 61 faces. That is, the channel plate 20 includes the air chamber 62 on the side opposite to the common channel 51 across the damper region 61. A part of the wall surface of the air chamber 62 is formed by the damper region 61. In other words, the surface of the damper region 61 opposite to the surface in contact with the common channel 51 is in contact with the air chamber 62.

The channel plate 20 includes a bridge portion 63 that partially divides the air chamber 62 in the nozzle arrangement direction. The bridge portion 63 is not in contact with the wall member (diaphragm member 30) and the nozzle plate 10.

The bridge portion 63 is formed at a position away from each surface of the channel plate 20 in a direction of thickness of the channel plate 20 so as not to be in contact with the wall member (diaphragm member 30) and the nozzle plate 10. In other words, in the channel plate 20, the concave portions 65 are formed from both surfaces of the channel plate 20 on both sides of the bridge portion 63, and thus the remaining portion is the bridge portion 63.

According to the present embodiment, the bridge portion 63 is provided in the air chamber 62 of the channel plate 20, thus preventing displacement of the bonding position due to reduction in rigidity of the channel plate 20.

In addition, according to the present embodiment, there is no portion in which a bonding failure occurs when the nozzle plate 10 and the channel plate 20 are pressed and bonded with an adhesive. Thus, abnormal vibration caused by the bonding failure can be prevented.

That is, since structurally connected portions affect each other, the way of transmission of the vibration changes depending on the bonding state. Accordingly, the bonding failure would cause the abnormal vibration. When a state in which stable bonding is not possible (bonding failure) occurs, the propagation state of vibration would change for each bonding state, thus causing variation in quality. Hence, in the present embodiment, the bridge portion 63 is not bonded to the nozzle plate 10 and the diaphragm member 30, thus preventing variation in the bonding state.

Further, since a difference in structural rigidity of the pressure chamber due to the bridge portion can be reduced in each nozzle, variation in discharge characteristics can be reduced.

Figure 4A:
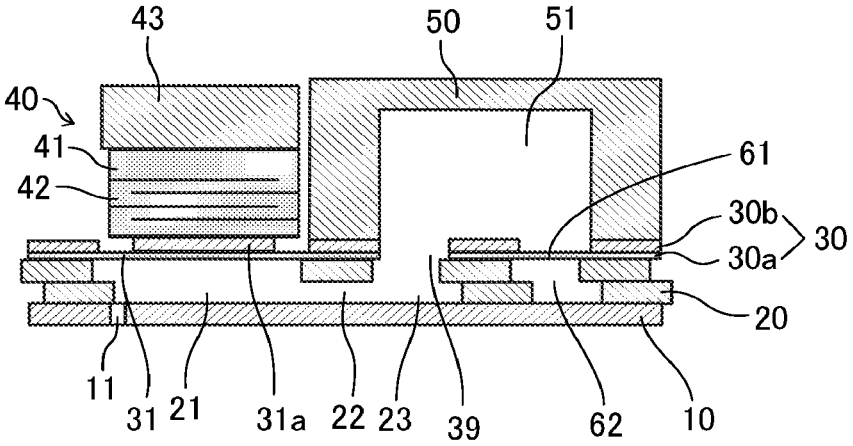
FIGS. 4A and 4B are cross-sectional views of a liquid discharge head according to Comparative Example 1.
Figure 4B:
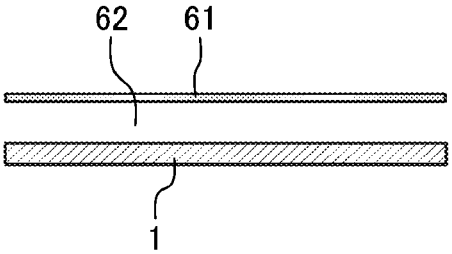
Figure 5A:
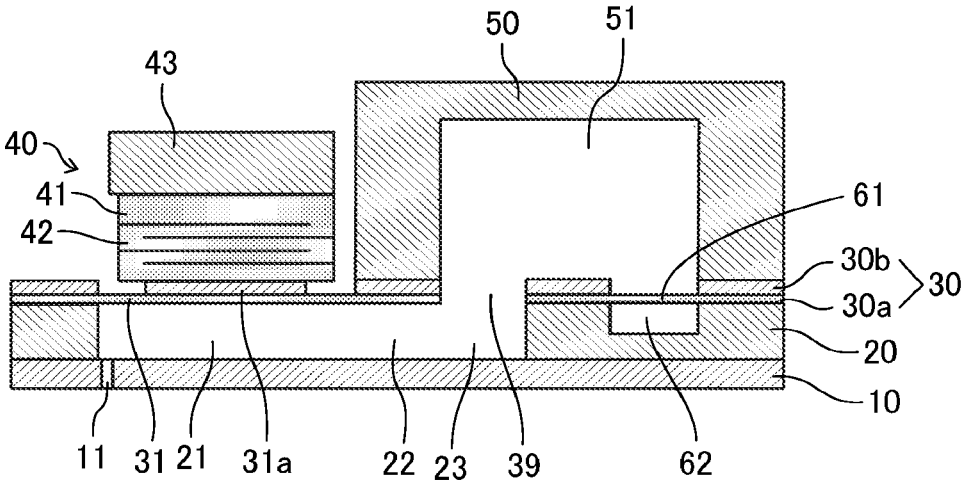
FIGS. 5A and 5B are cross-sectional views of a liquid discharge head according to Comparative Example 2.
Figure 5B:
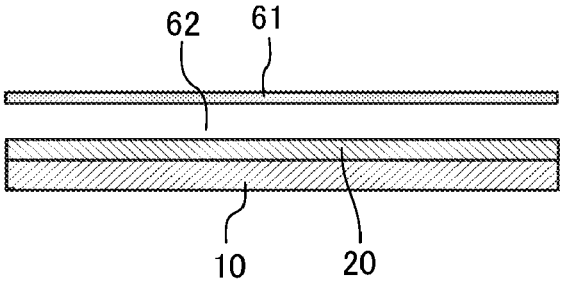
Figure 6A:
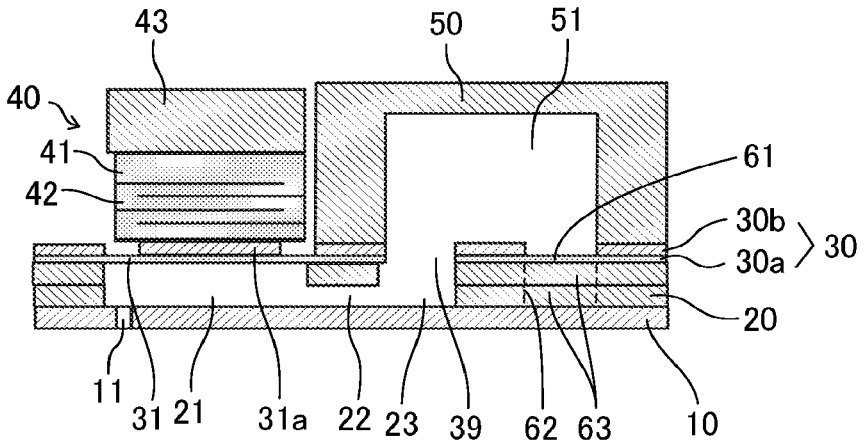
FIGS. 6A and 6B are cross-sectional views of a liquid discharge head according to Comparative Example 3.
Figure 6B:
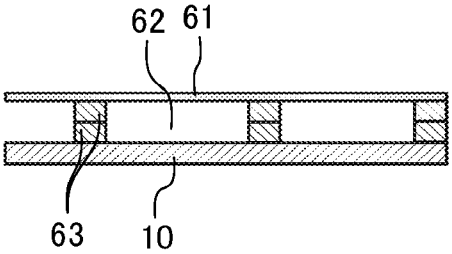

Comparative Examples 1 to 3 are described with reference to FIGS. 4A to 6B in order to describe operation and effects of the present embodiment. FIGS. 4A, 4B, 5A, 5B, 6A, and 6B are cross-sectional views of liquid discharge heads according to Comparative Examples 1 to 3. FIGS. 4A, 5A, and 6A are sectional views of liquid discharge heads along a direction orthogonal to the nozzle arrangement direction. FIGS. 4B, 5B, and 6B are sectional views of gas chamber portions of the liquid discharge heads of illustrated in FIGS. 4A, 5A, and 6A, respectively, along the nozzle arrangement direction.

In Comparative Example 1 of FIGS. 4A and 4B, an air chamber 62 penetrating a channel plate 20 is provided and no bridge portion is provided. In Comparative Example 1, the rigidity of the channel plate 20 is reduced due to the absence of the bridge portion.

In Comparative Example 2 illustrated in FIGS. 5A and 5B, a channel plate 20 is provided with an air chamber 62 having a concave shape and has no bridge portion. In Comparative Example 2, when a nozzle plate 10 and the channel plate 20 are pressed and bonded to each other with an adhesive, the pressing force is likely to be insufficient in the portion of the air chamber 62 and accordingly, a bonding failure is likely to occur.

In Comparative Example 3 illustrated in FIG. 6, a concave-shaped air chamber 62 is provided in a channel plate 20, and a bridge portion 63 that is in contact with a diaphragm member 30 and a nozzle plate 10 is provided. In Comparative Example 3, the rigidity of the pressure chamber is different between a nozzle 11 corresponding to a portion in which the nozzle plate 10, the channel plate 20, and the diaphragm member 30 are bonded to each other with the bridge portion 63 and another nozzle 11 not corresponding to the portion, and thus a periodic variation occurs in the discharge characteristics.

According to the present embodiment, the above-described failures of Comparative Examples 1 to 3 can be solved.

Figure 7:
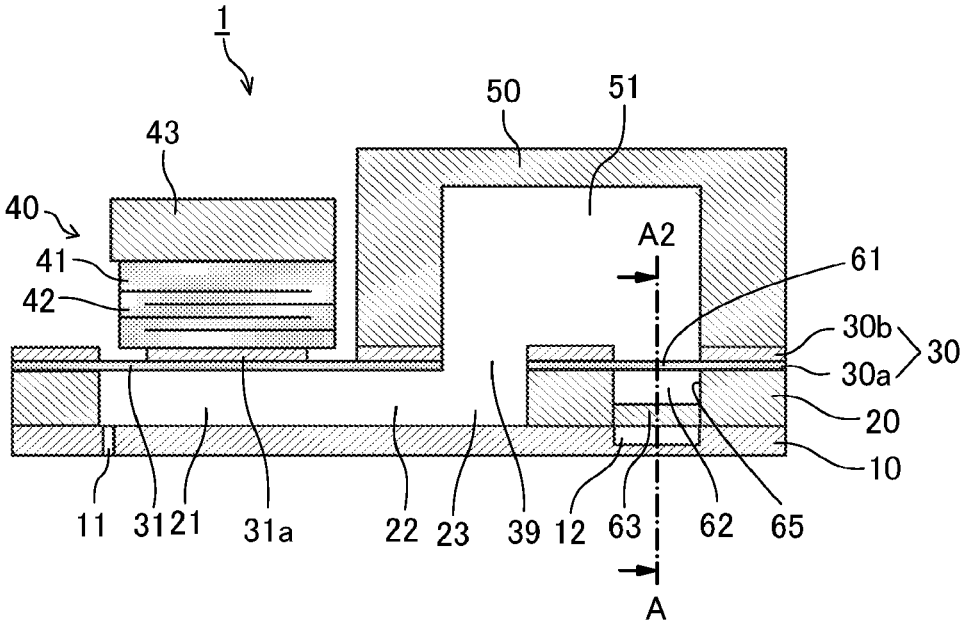
FIG. 7 is a cross-sectional view of a liquid discharge head according to a second embodiment of the present disclosure, taken along line B2-B2 in FIG. 8B in a direction perpendicular to a nozzle array direction of the liquid discharge head.
Figure 8A:
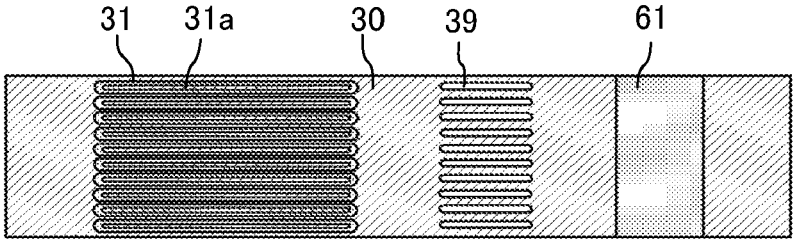
FIGS. 8A, 8B, and 8C are plan views of members of the liquid discharge head illustrated in FIG. 7.
Figure 8B:
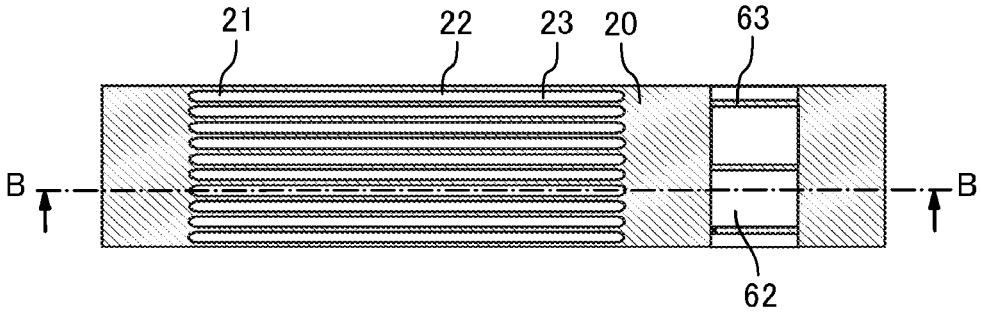
Figure 8C:
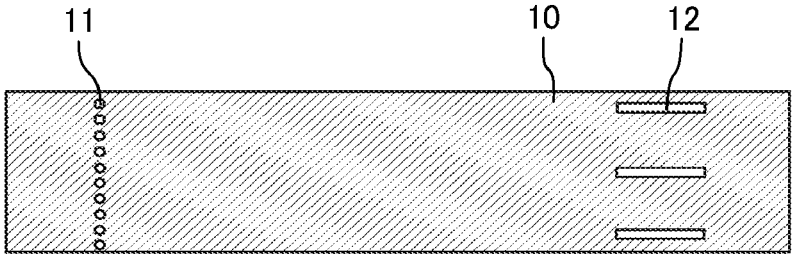
Figure 9:
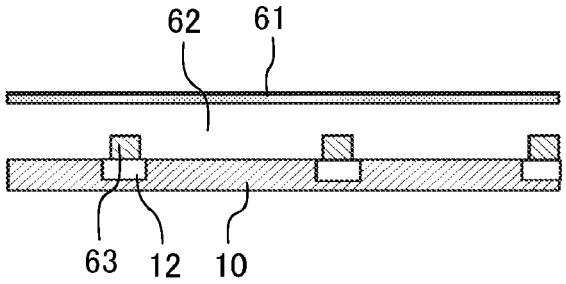
FIG. 9 is a cross-sectional view of the liquid discharge head taken along line A2-A2 in FIG. 7 in the nozzle arrangement direction.

Referring to FIGS. 7 to 9, a description is given of a second embodiment of the present disclosure. FIG. 7 is a cross-sectional view of a liquid discharge head according to the second embodiment, taken along line B2-B2 of FIG. 8B in a direction orthogonal to the nozzle arrangement direction of the liquid discharge head. FIGS. 8A to 8C are plan views of members of the liquid discharge head of FIG. 7. FIG. 9 is a cross-sectional view of the liquid discharge head taken along line A2-A2 of FIG. 7 in the nozzle arrangement direction.

In the present embodiment, a bridge portion 63 of a channel plate 20 is offset to the side of a nozzle plate 10 in a direction of thickness of the liquid discharge head. A side (wall member side) of the bridge portion 63 facing the diaphragm member 30 is not in contact with (is away from) the diaphragm member 30.

The nozzle plate 10 includes a concave portion 12 in a portion corresponding to the bridge portion 63. The concave portion 12 formed in the nozzle plate 10 causes the bridge portion 63 and the nozzle plate 10 to be in non-contact with each other (be separated from each other). Other configurations are the same as the configurations of the first embodiment.

As described above, the surface of the bridge portion 63 of the channel plate 20 at the side facing the nozzle plate 10 forms the same surface as the surface of the channel plate 20. Thus, a decrease in the rigidity of the channel plate 20 can be restrained and the difficulty of processing the channel plate 20 can be reduced.

Figure 10:
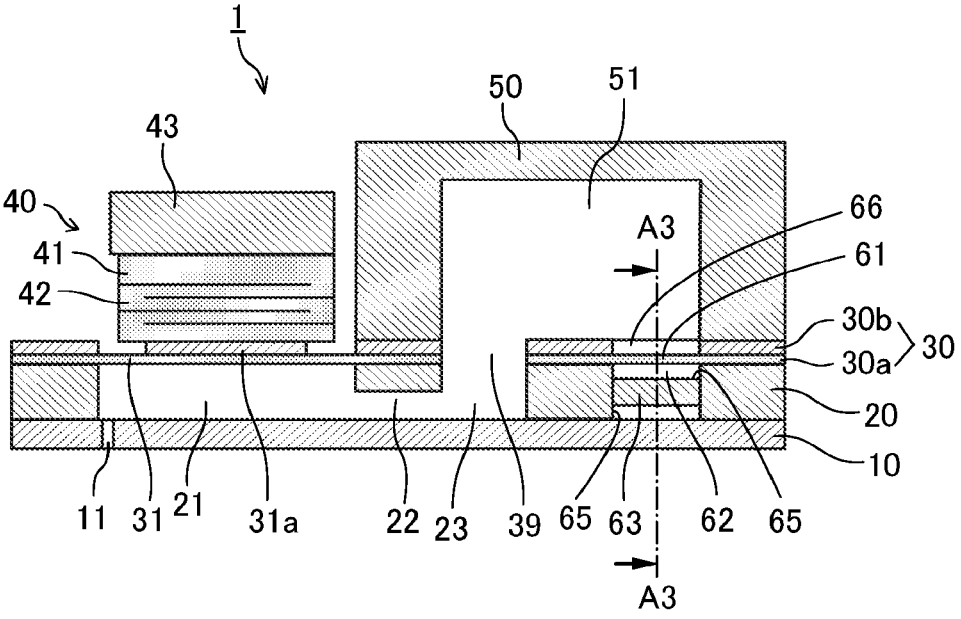
FIG. 10 is a cross-sectional view of a liquid discharge head according to a third embodiment of the present disclosure, taken along line B3-B3 in FIG. 11B in a direction perpendicular to a nozzle array direction of the liquid discharge head.
Figure 11A:
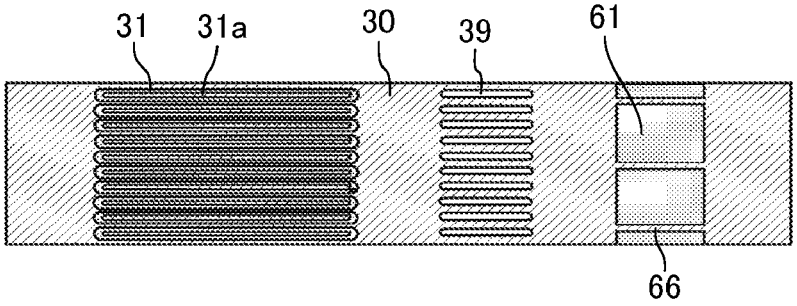
FIGS. 11A, 11B, and 11C are plan views of members of the liquid discharge head illustrated in FIG. 10.
Figure 11B:
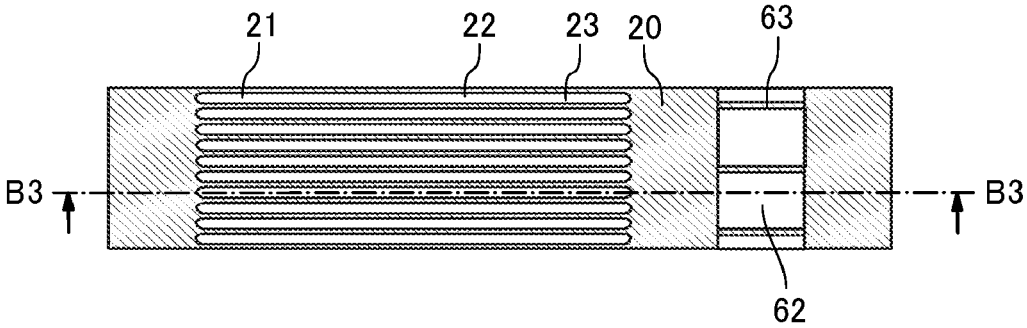
Figure 11C:
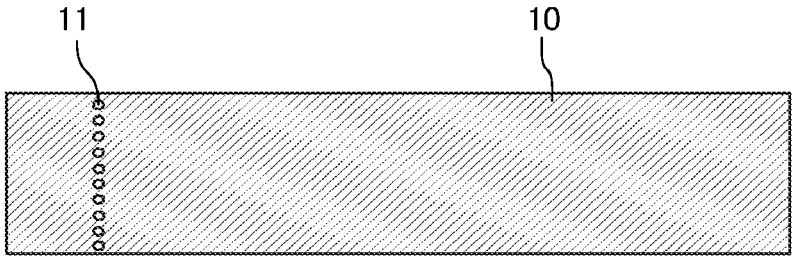
Figure 12:
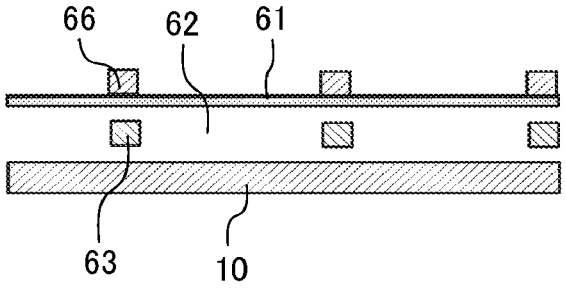
FIG. 12 is a cross-sectional view of the liquid discharge head taken along line A3-A3 in FIG. 10 in the nozzle arrangement direction.

Referring to FIGS. 10 to 12, a description is given of a third embodiment of the present disclosure. FIG. 10 is a cross-sectional view of a liquid discharge head according to the third embodiment, taken along line B3-B3 of FIG. 11B in a direction orthogonal to the nozzle arrangement direction of the liquid discharge head. FIGS. 11A to 11C are plan views of members of the liquid discharge head of FIG. 10. FIG. 12 is a cross-sectional view of the liquid discharge head taken along line A3-A3 of FIG. 10 in the nozzle arrangement direction.

In the present embodiment, a reinforcing portion 66 is provided in a damper region 61 on a side facing a common channel 51 in the configuration of the first embodiment. The reinforcing portion 66 is provided in a direction orthogonal to the nozzle arrangement direction and divides the damper region 61 into a plurality of regions in the nozzle arrangement direction.

As described above, the reinforcing portion 66 in the damper region 61, though reduces the deformation amount of the damper region 61, can prevent the distribution (unevenness) of the compliance effect due to the position in the nozzle arrangement direction (longitudinal direction) of a common channel 51.

Figure 13:
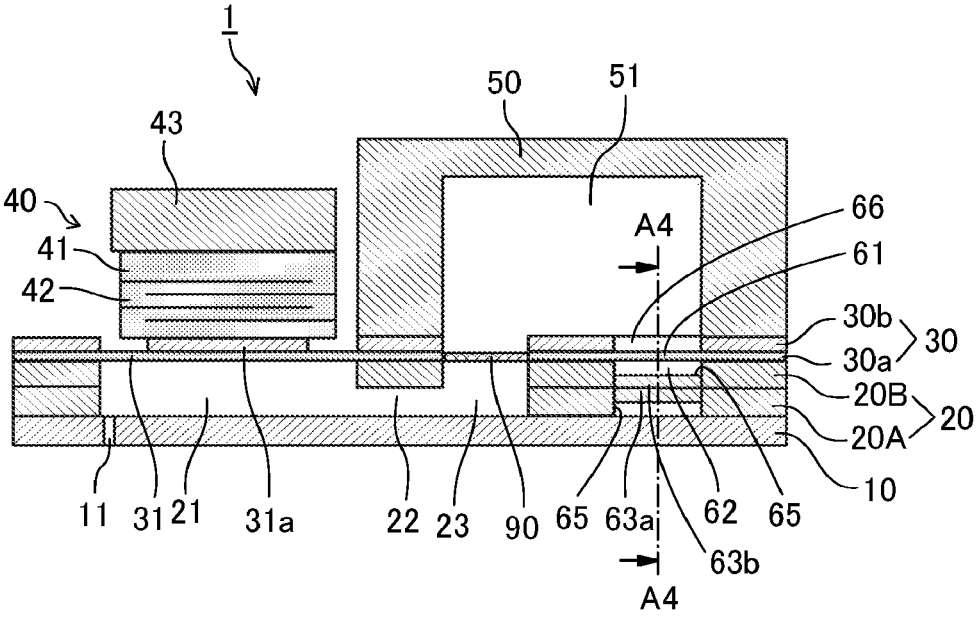
FIG. 13 is a cross-sectional view of a liquid discharge head according to a fourth embodiment of the present disclosure, taken along line B4-B4 in FIG. 14C in a direction perpendicular to a nozzle array direction of the liquid discharge head.
Figure 14A:
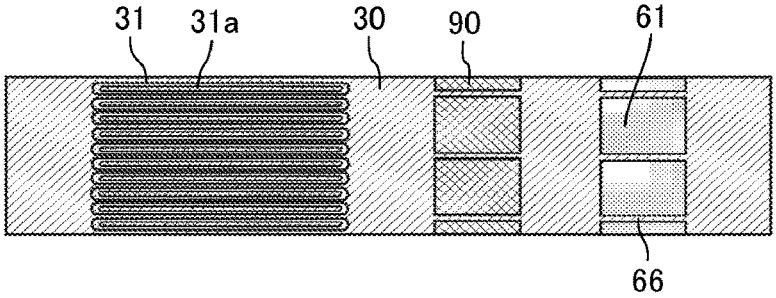
FIGS. 14A, 14B, 14C, and 14D are plan views of members of the liquid discharge head illustrated in FIG. 13.
Figure 14B:
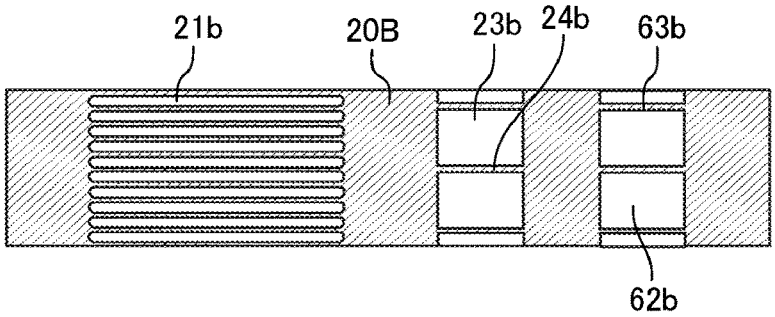
Figure 14C:
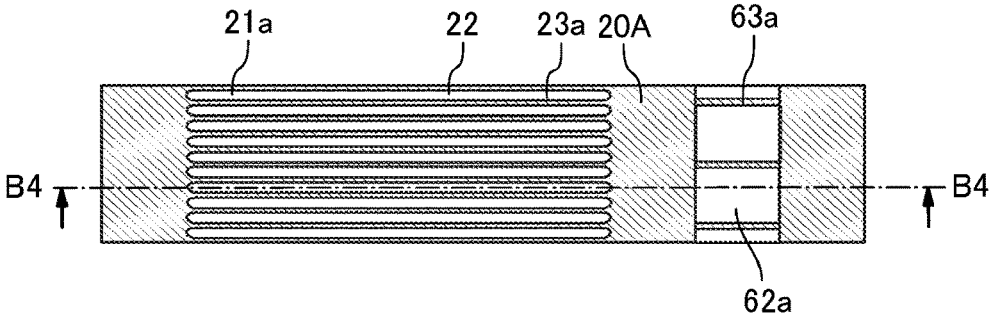
Figure 14D:
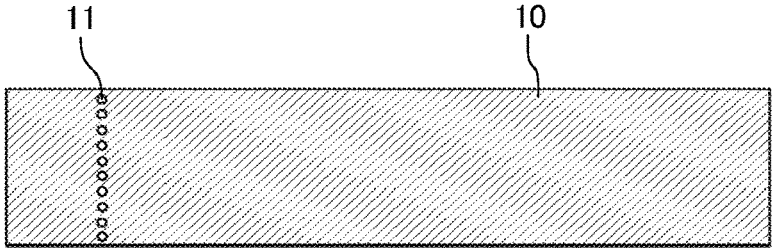
Figure 15:
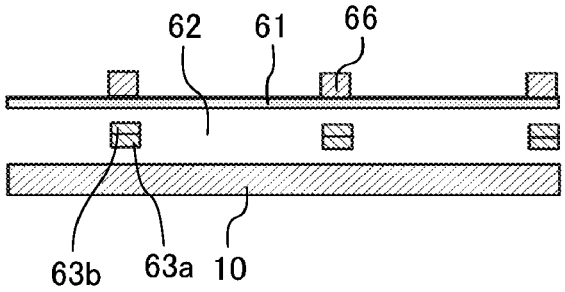
FIG. 15 is a cross-sectional view of the liquid discharge head taken along line A4-A4 in FIG. 13 in the nozzle arrangement direction.

Referring to FIGS. 13 to 15, a description is given of a fourth embodiment of the present disclosure. FIG. 13 is a cross-sectional view of a liquid discharge head according to the third embodiment, taken along line B4-B4 of FIG. 14C in a direction orthogonal to the nozzle arrangement direction of the liquid discharge head. FIGS. 14A to 14D are plan views of members of the liquid discharge head of FIG. 13. FIG. 15 is a cross-sectional view of the liquid discharge head taken along line A4-A4 of FIG. 13 in the nozzle arrangement direction.

In the present embodiment, a channel plate 20 is formed with two plate members 20A and 20B laminated one on another.

The plate member 20A forms a groove portion constituting a portion 21*a* of a pressure chamber 21, an individual supply channel 22, and a portion 23*a* of an intermediate supply channel 23.

The plate member 20B forms a groove portion constituting a portion 21*b* of the pressure chamber 21 and an opening portion constituting a portion 23*b* of the intermediate supply channel 23. A portion 23*b* of the intermediate supply channel 23 is divided by a bridge portion 24*b* into a plurality of parts in the nozzle arrangement direction and is provided over the portions 23*a* of the plurality of intermediate supply channels 23 communicated with the plurality of pressure chambers 21.

The plate member 20A forms a portion 62*a* of an air chamber 62 and a bridge portion 63*a* The plate member 20B forms a portion 62*b* of the air chamber 62 and a bridge portion 63*b*. In the present embodiment, the bridge portion 63*a* formed by the plate member 20A and the bridge portion 63*b* formed by the plate member 20B are disposed at the same position in the nozzle arrangement direction.

Such a configuration allows one surface of each of the bridge portions 63*a* and 63*b* in the direction of thickness of the channel plate 20 to form the same surface as one surface of each of the plate members 20A and 20B in the direction of thickness of the channel plate 20. Thus, the difficulty in processing the channel plate 20 can be reduced.

In the present embodiment, a filter portion 90 is disposed between a common channel 51 and the intermediate supply channel 23. The filter portion 90 is formed in the first layer 30*a* of the diaphragm member 30.

Figure 16:
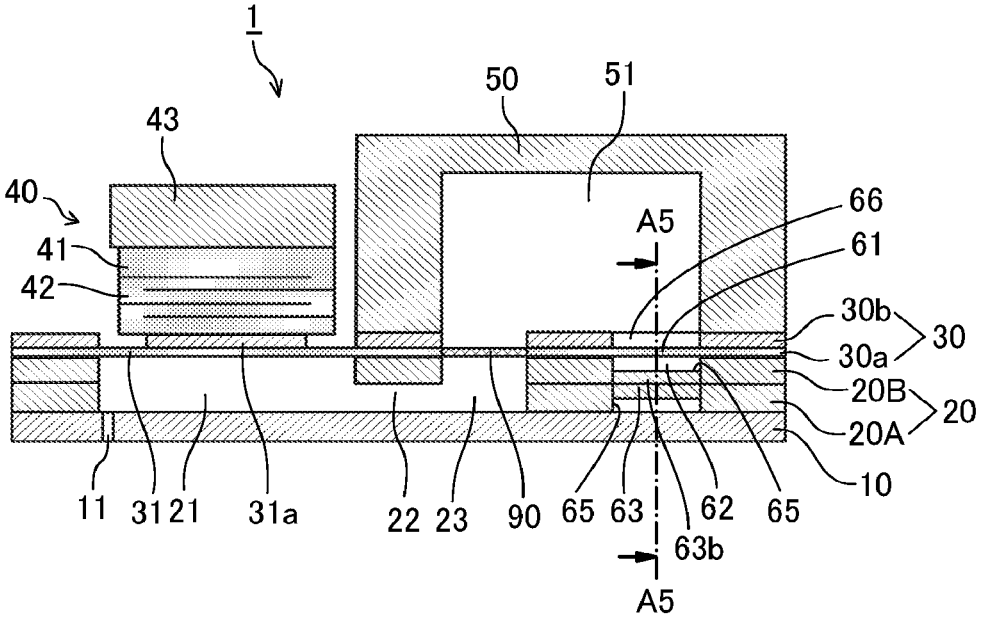
FIG. 16 is a cross-sectional view of a liquid discharge head according to a fifth embodiment of the present disclosure, taken along line B5-B5 in FIG. 17C in a direction perpendicular to a nozzle array direction of the liquid discharge head.
Figure 17A:
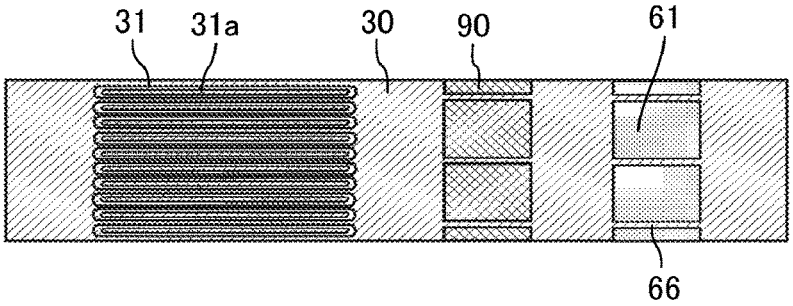
FIGS. 17A, 17B, 17C, and 17D are plan views of members of the liquid discharge head illustrated in FIG. 16.
Figure 17B:
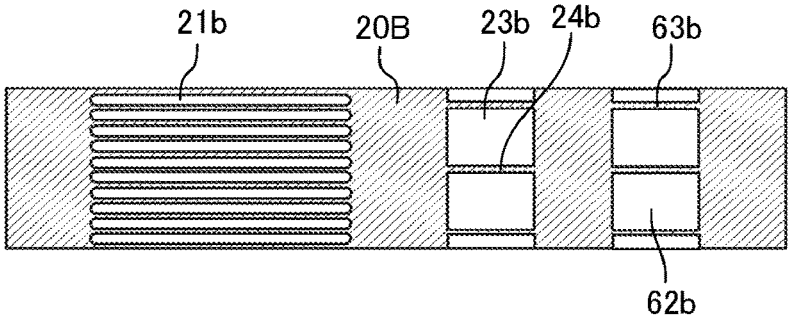
Figure 17C:
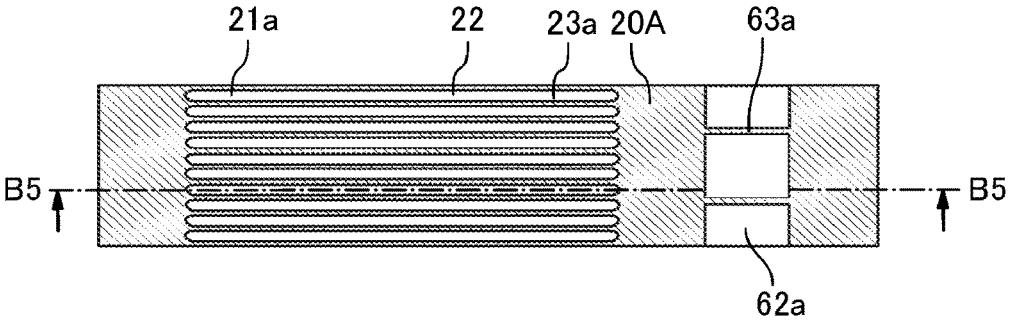
Figure 17D:
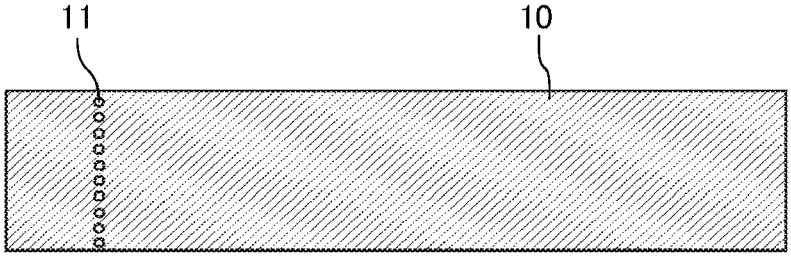
Figure 18:
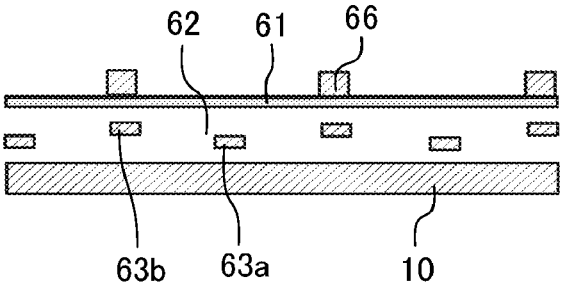
FIG. 18 is a cross-sectional view of the liquid discharge head taken along line A5-A5 in FIG. 16 in the nozzle arrangement direction.

Referring to FIGS. 16 to 18, a description is given of a fifth embodiment of the present disclosure. FIG. 16 is a cross-sectional view of a liquid discharge head according to the third embodiment, taken along line B5-B5 of FIG. 17C in a direction orthogonal to the nozzle arrangement direction of the liquid discharge head. FIGS. 17A to 17D are plan views of members of the liquid discharge head of FIG. 16. FIG. 18 is a cross-sectional view of the liquid discharge head taken along line A5-A5 of FIG. 16 in the nozzle arrangement direction.

In the present embodiment, similarly to the fourth embodiment, a plate member 20B on the side facing a diaphragm member 30 forms a groove portion constituting a portion 21*b* of a pressure chamber 21 and an opening portion constituting a portion 23*b* of an intermediate supply channel 23. A portion 23*b* of the intermediate supply channel 23 is divided by a bridge portion 24*b* into a plurality of parts in the nozzle arrangement direction and is provided over the portions 23*a* of the plurality of intermediate supply channels 23 communicated with the plurality of pressure chambers 21.

In the present embodiment, bridge portions 63*a* formed by the plate member 20A and bridge portion 63*b* formed by the plate member 20B are alternately arranged at different positions in the nozzle arrangement direction.

Accordingly, when the plate member 20A and the plate member 20B are bonded to each other, the bridge portion 63*a* and the bridge portion 63*b* are not bonded to each other. Thus, occurrence of abnormal vibration due to poor joining of the bridge portions can be prevented.

Figure 19:
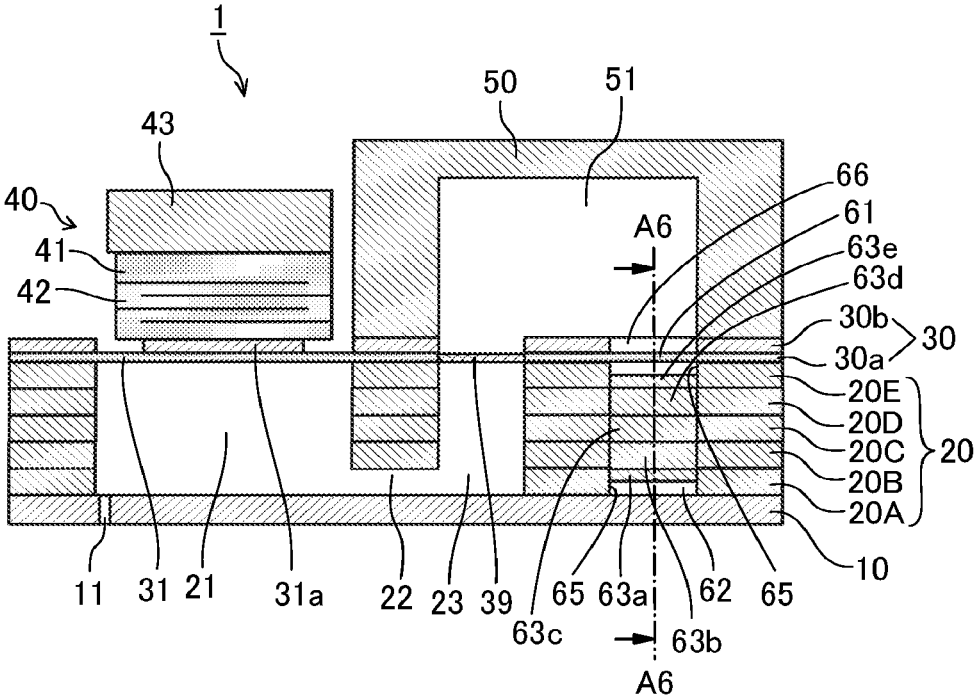
FIG. 19 is a cross-sectional view of a liquid discharge head according to a sixth embodiment of the present disclosure, taken along line B6-B6 in FIG. 20F in a direction perpendicular to a nozzle array direction of the liquid discharge head.
Figure 20A:
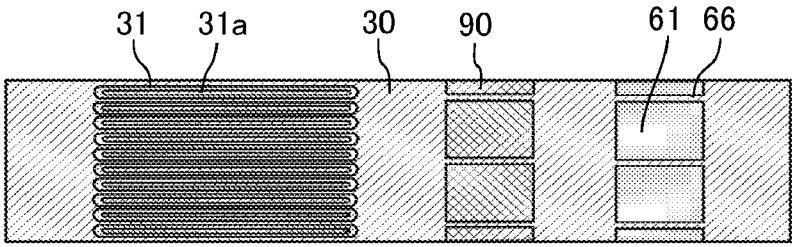
FIGS. 20A, 20B, 20C, 20D, 20E, 20F, and 20G are plan views of members of the liquid discharge head illustrated in FIG. 19.
Figure 20B:
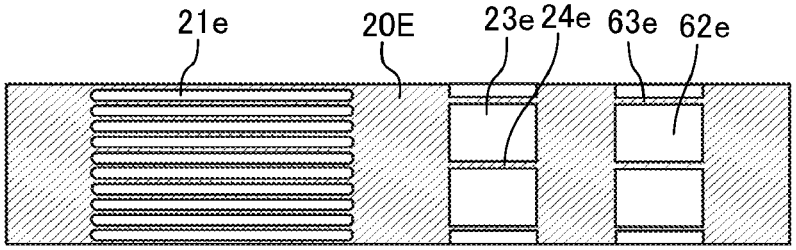
Figure 20C:
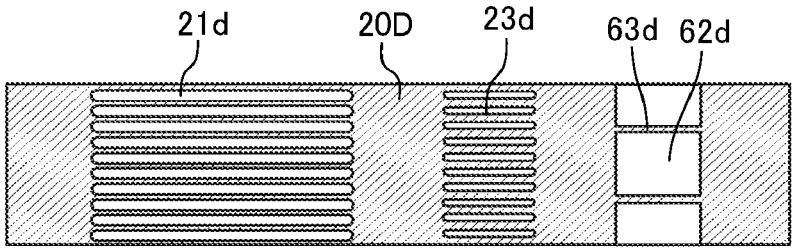
Figure 20D:
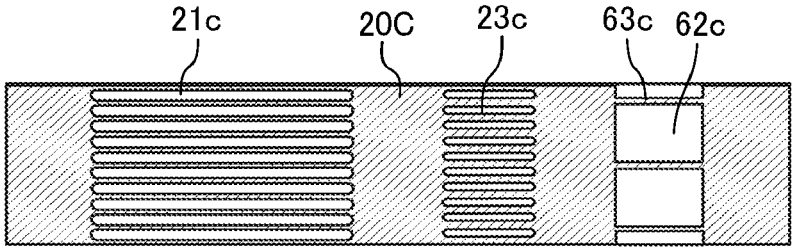
Figure 20E:
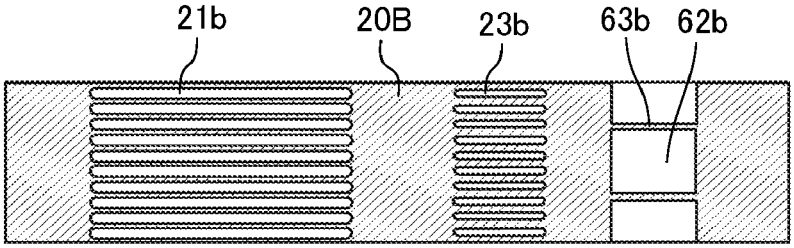
Figure 20F:
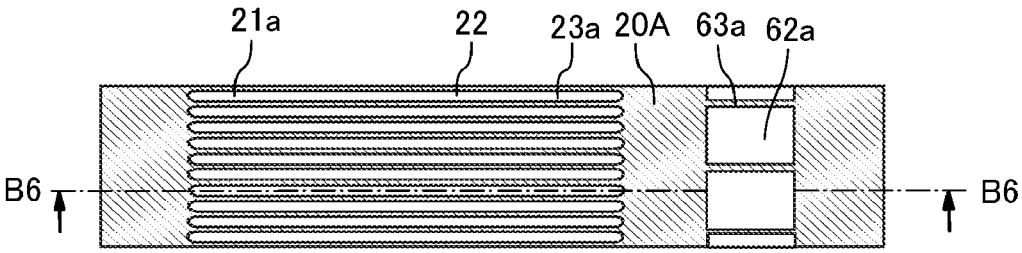
Figure 20G:
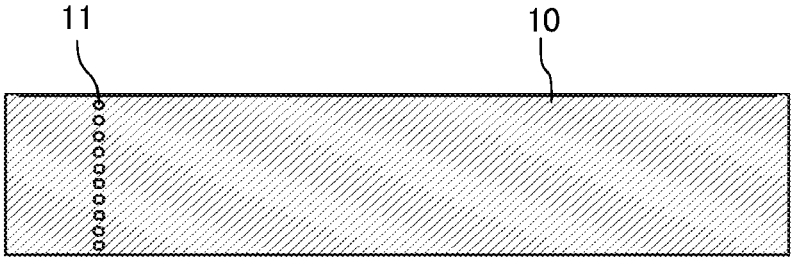
Figure 21:
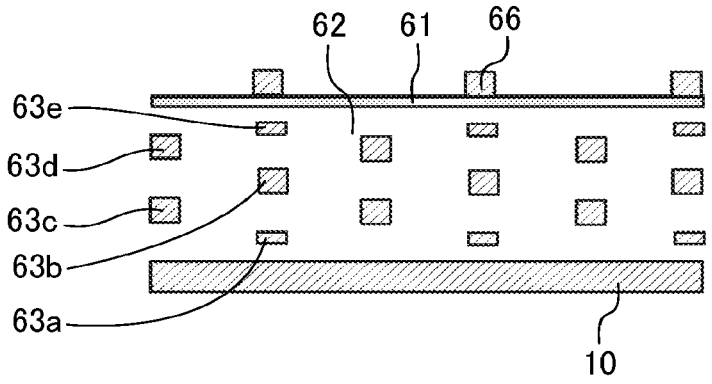
FIG. 21 is a cross-sectional view of the liquid discharge head taken along line A6-A6 in FIG. 19 in the nozzle arrangement direction.

Referring to FIGS. 19 to 21, a description is given of a sixth embodiment of the present disclosure. FIG. 19 is a cross-sectional view of a liquid discharge head according to the third embodiment, taken along line B6-B6 of FIG. 20F in a direction orthogonal to the nozzle arrangement direction of the liquid discharge head. FIGS. 20A, 20B, 20C, 20D, 20E, 20F, and 20G are plan views of members of the liquid discharge head of FIG. 19. FIG. 21 is a cross-sectional view of the liquid discharge head taken along line A6-A6 of FIG. 19 in the nozzle arrangement direction.

In the present embodiment, a channel plate 20 is formed with five plate members 20A to 20E laminated one on another.

The plate member 20A forms a groove portion constituting a portion 21*a* of a pressure chamber 21, an individual supply channel 22, and a portion 23*a* of an intermediate supply channel 23.

The plate member 20B forms a groove portion constituting a portion 21*b* of the pressure chamber 21 and a portion 23*b* of the intermediate supply channel 23. The plate member 20C forms a groove portion constituting a portion 21*c* of the pressure chamber 21 and a portion 23*c* of the intermediate supply channel 23. The plate member 20D forms a groove portion constituting a portion 21*d* of the pressure chamber 21 and a portion 23*d* of the intermediate supply channel 23.

The plate member 20E forms a groove portion constituting a portion 21*e* of the pressure chamber 21 and an opening portion constituting a portion 23*e* of the intermediate supply channel 23. The portion 23*e* of the intermediate supply channel 23 is divided by a bridge portion 24*e* into a plurality of parts in the nozzle arrangement direction and is provided over the portions 23*a* to 23*d* of the plurality of intermediate supply channels 23 communicated with the plurality of pressure chambers 21.

The plate member 20A forms a portion 62*a* of an air chamber 62 and a bridge portion 63*a* The plate member 20B forms a portion 62*b* of the air chamber 62 and a bridge portion 63*b*. The plate member 20C forms a portion 62*c* of the air chamber 62 and a bridge portion 63*c*. The plate member 20D forms a portion 62*d* of the air chamber 62 and a bridge portion 63*d*. The plate member 20E forms a portion 62*e* of the air chamber 62 and a bridge portion 63*e*.

In the present embodiment, the bridge portions 63*a* to 63*e* are formed by the plate members 20A to 20E, and adjacent ones of the bridge portions 63*a* to 63*e* adjacent to each other in the thickness direction of the channel plate 20 are disposed at different positions in the nozzle arrangement direction.

Such a configuration can prevent occurrence of abnormal vibration due to a bonding failure between bridge portions adjacent to each other in the direction of thickness of the channel plate 20. Further, in the present embodiment, the number of arrangement position patterns of the bridge portions is two, thus allowing achievement of the commonality of components. Note that the number of arrangement position patterns of the bridge portions is not limited to two but may be three or more.

Figure 22:
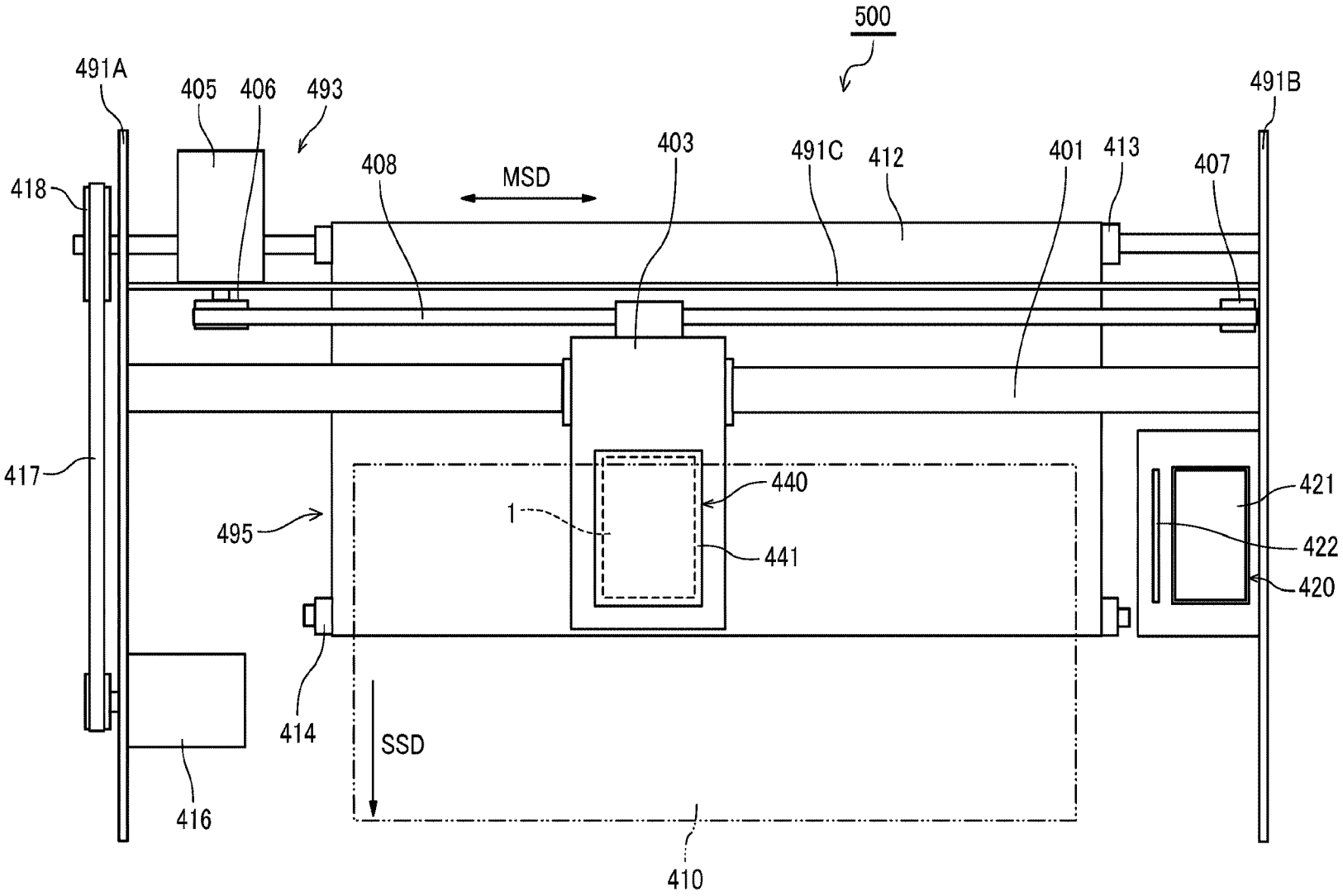
FIG. 22 is a plan view of a main part of a liquid discharge apparatus according to an embodiment of the present disclosure.
Figure 23:
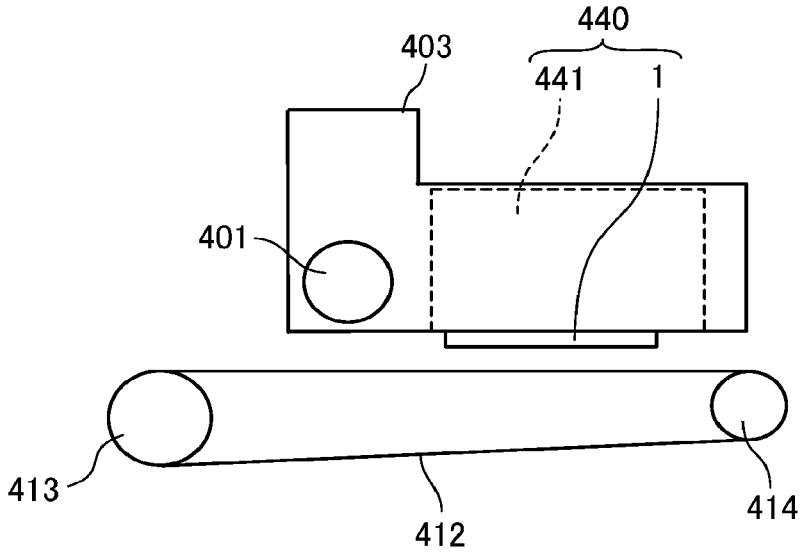
FIG. 23 is a side view of the main part of the liquid discharge apparatus illustrated in FIG. 22.

Next, a printing apparatus as a liquid discharge apparatus according to an embodiment of the present disclosure is described with reference to FIGS. 22 and 23. FIG. 22 is a plan view of a main part of the liquid discharge apparatus according to an embodiment of the present disclosure. FIG. 23 is a side view of the main part of the liquid discharge apparatus of FIG. 22.

A printing apparatus 500 serving as the liquid discharge apparatus according to the present embodiment is a serial-type apparatus in which a main-scanning moving mechanism 493 reciprocates a carriage 403 in main scanning directions indicated by arrow MSD in FIG. 22. A main-scanning moving mechanism 493 includes, e.g., a guide 401, a main-scanning motor 405, and a timing belt 408. The guide 401 is bridged between left and right side plates 491A and 491B to moveably hold the carriage 403. The main-scanning motor 405 reciprocates the carriage 403 in the main-scanning directions MSD via the timing belt 408 bridged between a drive pulley 406 and a driven pulley 407.

A liquid discharge device 440 is mounted on the carriage 403. In the liquid discharge device 440, a liquid discharge head 1 and a head tank 441 according to an embodiment of the present disclosure are integrated.

The liquid discharge head 1 of the liquid discharge device 440 discharges color liquids of, for example, yellow (Y), cyan (C), magenta (M), and black (K). The liquid discharge head 1 is mounted on the carriage 403 such that a nozzle row including a plurality of nozzles is arranged in a sub-scanning direction indicated by arrow SSD in FIG. 22 perpendicular to the main scanning direction MSD and a direction of discharge of color liquid is downward.

The printing apparatus 500 includes a conveyance mechanism 495 to convey a sheet 4101. The conveyance mechanism 495 includes a conveyance belt 412 serving as a conveyor and a sub-scanning motor 416 to drive the conveyance belt 412.

The conveyance belt 412 attracts the sheet 410 and conveys the sheet 410 to a position facing the liquid discharge head 1. The conveyance belt 412 is an endless belt stretched between a conveyance roller 413 and a tension roller 414. The sheet 410 can be attracted to the conveyance belt 412 by electrostatic attraction, air suction, or the like.

The conveyance belt 412 circumferentially moves in the sub-scanning direction SSD as the conveyance roller 413 is rotationally driven by the sub-scanning motor 416 via a timing belt 417 and a timing pulley 418.

On one side of the carriage 403 in the main scanning direction MSD, a maintenance mechanism 420 that maintains and recovers the liquid discharge head 1 is disposed lateral to the conveyance belt 412.

The maintenance mechanism 420 includes, for example, a cap 421 to cap a nozzle face (i.e., a face on which nozzles are formed) of the liquid discharge head 1 and a wiper 422 to wipe the nozzle face.

The main-scanning moving mechanism 493, the maintenance mechanism 420, and the conveyance mechanism 495 are installed onto a housing including the side plates 491A and 491B and a back plate 491C.

In the printing apparatus 500 having the above-described configuration, the sheet 410 is fed and attracted onto the conveyance belt 412 and conveyed in the sub-scanning direction SSD by the circumferential movement of the conveyance belt 412.

The liquid discharge head 1 is driven in response to an image signal while moving the carriage 403 in the main scanning direction MSD to discharge the liquid onto the sheet 410 not in motion, thereby recording an image.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The liquid discharge device is an integrated unit including the liquid discharge head and a functional part(s) or unit(s), and is an assembly of parts relating to liquid discharge. Examples of the liquid discharge device include a combination of a liquid discharge head with at least one of a head tank, a carriage, a supply mechanism, a maintenance mechanism, a main-scanning moving mechanism, and a liquid circulation device.

When it is stated that a liquid discharge head and functional components/mechanisms are integrated with each other, it refers to a case in which the liquid discharge head and the functional components/mechanisms are secured to each other by means of fastening, bonding, or engaging, or another case in which one of the liquid discharge head and the functional components/mechanisms is movably supported by the other one of them. Further, a liquid discharge head, a functional component(s), and a mechanism(s) may be attachable to and detachable from each other.

For example, the liquid discharge head and the head tank are integrated as the liquid discharge device. Alternatively, the liquid discharge head may be coupled with the head tank through a tube or the like to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device includes the liquid discharge head movably held by a guide that forms part of a main scan moving unit, so that the liquid discharge head and the main scan moving unit are integrated as a single integrated unit. The liquid discharge device may include the head, the carriage, and the main scan moving unit that are integrated as a single unit.

In still another example, the cap that forms part of the maintenance unit is secured to the carriage mounting the liquid discharge head so that the liquid discharge head, the carriage, and the maintenance unit are integrated as a single unit to form the liquid discharge device. Further, in still another example, the liquid discharge device includes tubes connected to the head tank or the head mounting the channel member so that the liquid discharge head and the supply unit are integrated as a single unit. Through the tube, the liquid of the liquid storage source such as an ink cartridge is supplied to the head.

Examples of the main-scanning moving mechanism include a single guide. The supply mechanism may be a tube(s) only or a loading unit only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A liquid discharge head, comprising:

a nozzle plate including a plurality of nozzles configured to discharge liquid;

a channel plate including a plurality of pressure chambers communicated with the plurality of nozzles, respectively;

a common channel substrate including a common channel communicated with the plurality of pressure chambers; and a wall member including a deformable region in a part of a wall surface of the common channel, wherein the channel plate and the common channel substrate are disposed with the wall member interposed between the channel plate and the common channel substrate, the channel plate includes an air chamber facing the deformable region, the channel plate includes a bridge portion partially dividing the air chamber in a nozzle arrangement direction in which the plurality of nozzles are arranged, and the bridge portion is not in contact with the wall member and the nozzle plate.

2. The liquid discharge head according to claim 1, wherein the bridge portion is away from the wall member and the nozzle plate.

3. The liquid discharge head according to claim 1, wherein the bridge portion is away from the wall member, and the nozzle plate includes a concave portion corresponding to the bridge portion.

4. The liquid discharge head according to claim 1, further comprising a reinforcing portion at a position corresponding to the bridge portion on a side of the deformable region facing the common channel.

5. The liquid discharge head according to claim 1,
wherein the channel plate includes a plurality of plate members laminated one on another,
the plurality of plate members includes a first plate member on a side facing the nozzle plate and a second plate member on a side facing the wall member, and
the first plate member and the second plate member include a bridge portion that is not in contact with at least the nozzle plate or the wall member.

6. The liquid discharge head according to claim 5,
wherein the plurality of plate members includes a plurality of bridge portions, including the bridge portion, disposed at different positions in the nozzle arrangement direction between at least two plate members of the plurality of plate members.

7. The liquid discharge head according to claim 5,
wherein the plurality of plate members includes a plurality of bridge portions, including the bridge portion, disposed at different positions in the nozzle arrangement direction between adjacent ones of the plurality of plate members, and
the adjacent ones are adjacent to each other at least in a direction of lamination of the plurality of plate members.

8. A discharge device, comprising the liquid discharge head according to claim 1.

9. A liquid discharge apparatus, comprising the discharge device according to claim 8.

10. A liquid discharge apparatus, comprising the liquid discharge head according to claim 1.

11. A liquid discharge head, comprising:
a plurality of nozzles configured to discharge liquid, the nozzles including a first wall comprised of a nozzle plate;
a plurality of pressure chambers respectively communicated with the nozzles, the pressure chambers including a second wall comprised of a channel plate;
a common channel communicated with the pressure chambers, the common channel including a third wall comprised of a common channel substrate; and
an air chamber having a wall member including a deformable region in a part of a wall surface of the common channel,
wherein the channel plate and the common channel substrate are disposed with the wall member interposed between the channel plate and the common channel substrate,
the channel plate includes a bridge portion partially dividing the air chamber in a nozzle arrangement direction in which the nozzles are arranged, and
the bridge portion is not in contact with the wall member and the nozzle plate.

12. The liquid discharge head according to claim 11,
wherein the bridge portion is away from the wall member and the nozzle plate.

13. The liquid discharge head according to claim 11,
wherein the bridge portion is away from the wall member, and
the nozzle plate includes a concave portion corresponding to the bridge portion.

14. The liquid discharge head according to claim 11, further comprising a reinforcing portion at a position corresponding to the bridge portion on a side of the deformable region facing the common channel.

15. The liquid discharge head according to claim 11,
wherein the channel plate includes a plurality of plate members laminated one on another,
the plurality of plate members includes a first plate member on a side facing the nozzle plate and a second plate member on a side facing the wall member, and
the first plate member and the second plate member include a bridge portion that is not in contact with at least the nozzle plate or the wall member.

16. The liquid discharge head according to claim 15,
wherein the plurality of plate members includes a plurality of bridge portions, including the bridge portion, disposed at different positions in the nozzle arrangement direction between at least two plate members of the plurality of plate members.

17. The liquid discharge head according to claim 15,
wherein the plurality of plate members includes a plurality of bridge portions, including the bridge portion, disposed at different positions in the nozzle arrangement direction between adjacent ones of the plurality of plate members, and
the adjacent ones are adjacent to each other at least in a direction of lamination of the plurality of plate members.

18. A discharge device, comprising the liquid discharge head according to claim 11.

19. A liquid discharge apparatus, comprising the discharge device according to claim 18.

20. A liquid discharge apparatus, comprising the liquid discharge head according to claim 11.

* * * * *